US005598592A

United States Patent [19]

Castellani

[11] Patent Number: 5,598,592

[45] Date of Patent: Feb. 4, 1997

[54] EASILY DECONTAMINATED STRETCHER

[75] Inventor: Robert A. Castellani, Elkridge, Md.

[73] Assignee: North America Rescue Products, Elkridge, Md.

[21] Appl. No.: 558,259

[22] Filed: Nov. 13, 1995

[51] Int. Cl.[6] ..... A47B 1/00; A47B 1/08

[52] U.S. Cl. ..... 5/627; 5/625

[58] Field of Search ..... 5/625, 626, 627, 5/628, 629

[56] References Cited

U.S. PATENT DOCUMENTS

| | | | |
|---|---|---|---|
| D. 301,021 | 5/1989 | Dommerud | D12/128 |
| D. 309,589 | 7/1990 | Hare et al. | D12/128 |
| 1,764,477 | 6/1930 | Weber-Stierlin | 5/627 |
| 2,133,692 | 10/1938 | Gittings et al. | 5/627 |
| 2,203,193 | 6/1940 | Ettinger | 5/627 |
| 2,226,306 | 12/1940 | Ettinger | 5/82 |
| 2,276,265 | 3/1942 | Visness et al. | 287/99 |
| 2,327,919 | 8/1943 | Montgomery | 5/627 |
| 2,335,140 | 11/1943 | Bell | 5/627 |
| 2,360,371 | 10/1944 | Schwichtenberg | 5/627 |
| 2,394,245 | 2/1946 | Koller | 5/625 |
| 3,110,912 | 11/1963 | Propst | 5/82 |
| 3,797,051 | 3/1974 | Evans | 5/627 |
| 3,859,677 | 1/1975 | Nordwig | 5/89 |
| 3,886,606 | 6/1975 | Bradford | 5/82 |
| 3,956,781 | 5/1976 | Reemelin | 5/114 |
| 4,403,052 | 9/1983 | Largman et al. | 524/80 |
| 4,670,921 | 6/1987 | Avni et al. | 5/82 |
| 4,783,862 | 11/1988 | Murphy | 5/625 |
| 4,947,418 | 8/1990 | Barr et al. | 5/606 |
| 5,154,487 | 10/1992 | Warburton | 297/465 |
| 5,317,770 | 6/1994 | Sakurai | 5/625 |

OTHER PUBLICATIONS

"Lightweight Combat Litter" product brochure, Night Vision Equipment Co., Inc., Emmaus, PA, 1993.

Neat Agent Testing on Field Little Cover Materials, AD–B117 108, Battelle Report, 1987.

Military Specification, Litter, Folding, Rigid Pole, Decontaminable, MIL–L–49511, 4 Dec. 1992, FSC 6530.

*Primary Examiner*—Steven N. Meyers
*Assistant Examiner*—Robert G. Santos
*Attorney, Agent, or Firm*—William S. Ramsey

[57] ABSTRACT

This stretcher allows the removal of a person from an area contaminated with hazardous materials, decontamination of the person and stretcher, and further transportation of the person to medical facilities, without removing the person from the stretcher. The stretcher is constructed of materials which are resistant to or protected from hazardous material and weathering, and in particular, the stretcher bed is constructed using a large honeycomb web and mesh which allows decontamination of the patient while supported by the stretcher.

11 Claims, 4 Drawing Sheets

EASILY DECONTAMINATED STRETCHER

BACKGROUND OF THE INVENTION

1. Field of the Invention

This invention relates to stretcher type devices used to transport accident victims, in particular, to stretcher type devices used to transport victims who have been exposed to hazardous materials.

2. Description of Related Art

The transportation of victims of hazardous material exposure poses unique challenges to emergency service personnel. Firstly, a victim must safely and quickly be removed from the "hot" area, the area of the hazardous material, Secondly, the victim must be decontaminated. This involves washing array the hazardous material (s) using a suitable solvent, generally water or a chemical and detergent solution. Finally, the victim must be transported to appropriate medical treatment facilitates via an ambulance, helicopter, or other appropriate means.

Current procedures require that a patient be moved from the location of exposure within a "hot" area to a decontamination point using a stretcher type device. Following decontamination, the patient must be transferred to a second non-contaminated stretcher type device. There are two reasons for this transfer. 1. The first stretcher type device is contaminated with the hazardous material and might introduce such contamination into the transportation vehicle and medical facilities, which increases the risk of exposure to others by lingering hazardous materials. 2. Current stretcher type devices do not allow complete decontamination of patients without moving them while on the device, due to pooling of hazardous materials between the patient's skin and the stretcher type device, termed "hot spots".

U.S. Pat. No. 4,037,871 discloses an ambulance cot with a base carrier structure and a removable stretcher attached to the top of the carrier. The stretcher may be removed for carrying patients down stairs, around comers, etc.

Decontaminating procedures are described in U.S. Pat. No. 5,205,306. Plain water or water solution of soap or detergents are used. The purpose of decontamination is to remove the hazardous material from the exposed victim and to dilute the chemical to the point where it no longer poses treat of injury or harm to an individual.

U.S. Pat. No. 3,110,912 discloses a litter having a bed manufactured of a net of warp knit nylon or Dacron fabric. The net material was described as uniquely able to be formed into compound load bearing shapes, strong, transparent to X-rays, able to withstand washing and sterilization, and not tending to hold moisture.

A study of various materials for litter beds, which emphasized tensile strength and capacity for easy decontamination, identified monofilament polypropylene as suitable material (R. L. Joiner, F. G. Burton, and P. E. Bailey, Neat Agent Testing On Field Litter Cover Materials, Report No. AD-B117 108, Battelle Columbus Division, Sep. 30, 1987).

A Department of Defense military specification for a decontaminable coating for aluminum, such as a stretcher, identified polyurethane as a suitable material. (MIL-L-49511, U.S. Army Biomedical Research and Development Laboratory, Fort Detrick, Frederick Md. 21701-5010, Dec. 4, 1992).

The stretcher of the present invention eliminates the need to transfer a patient from a first to second stretcher type device. This stretcher is manufactured of materials which do not react with hazardous materials and which may be readily decontaminated when the patient is decontaminated. Furthermore, this stretcher has a bed design that allows decontamination of a patient who remains on the stretcher without creating hot spots of hazardous materials.

SUMMARY OF THE INVENTION

The stretcher of this invention is constructed of rugged materials that are resistant to or protected from hazardous materials, fire, and UV light. Decontamination of the stretcher occurs while the patient is being decontaminated by conventional procedures.

The bed of the stretcher is constructed of a large mesh of monofilament polypropylene, which is resistant hazardous materials and may easily and safely be decontaminated. The large mesh bed prevents the patient from slipping on or from the bed while being carried or while being decontaminated. Additionally, the large mesh allows for the decontamination of the patient while on the stretcher without the risk of creating hot spots of hazardous materials where the patient is in contract with the bed. Such hot spots are a risk when solid surface materials, such as backboards, are used to support the patient during decontamination.

Aluminum components are coated with chemical resistant paint, such as polyurethane, are used for the stretcher frame.

The stretcher handles are made of chemical resistant rigid polyhexamethylene polyamide (nylon 6/6) to provide a strong handle resistant to hazardous materials, fire, and UV light. The handles have ridges and groves to provide a firm grip for responders wearing heavy rubber gloves, such as level A suit rubber gloves.

A patient may be decontaminated while lying on the stretcher bed of this invention. The stretcher bed is constructed throughout of a net having large mesh openings. This bed is specifically designed with large mesh in order to trap the patients body in the mesh, thus minimizing excessive movement of the patient on the bed. In addition, the large mesh makes it possible to decontaminate the patient by spraying decontaminating solvents on the patient from above and below the stretcher. Pooling of hazardous materials underneath the patient on the stretcher is avoided. The patient therefore may be decontaminated while on the stretcher bed while reducing risk of further injury.

The objective of this invention is to provide a rugged stretcher where all components are easily decontaminated of hazardous materials.

Another objective is to provide a stretcher where all components are resistant to or protected from hazardous materials, fire, and UV light.

Another objective is to provide a stretcher upon which a patient may be decontaminated.

Another objective is to provide a stretcher which prevents a patient from slipping from the stretcher bed while being decontaminated and transported.

Another objective is to provide a stretcher which may be used to transport a patient from a contaminated zone, support the patient during decontamination, and used to support the patient during transportation to a medical facility without requiring movement of the patient from or on the stretcher.

Another objective is to provide a stretcher which may be used to transport patients contaminated with hazardous materials and which may be folded to facilitate its transportation and storage when not in use.

Another objective is to provide a rugged and durable stretcher to be used in mass casualty emergencies.

Another objective is to provide a stretcher which is easily decontaminated of human body fluids.

A final objective is to provide a stretcher which may be constructed of inexpensive materials and is environmentally benign.

DESCRIPTION OF THE PREFERRED EMBODIMENTS

In this patent the term "hazardous materials" is used to include hazardous, or dangerous or unsafe chemicals, radioactive or poisonous elements, human body fluids, chemicals constituting a fire hazard, and when appropriate, chemicals used to decontaminate victims, such as a weak acid wash used to decontaminate victims contaminated with an alkaline solution.

Figure 1:
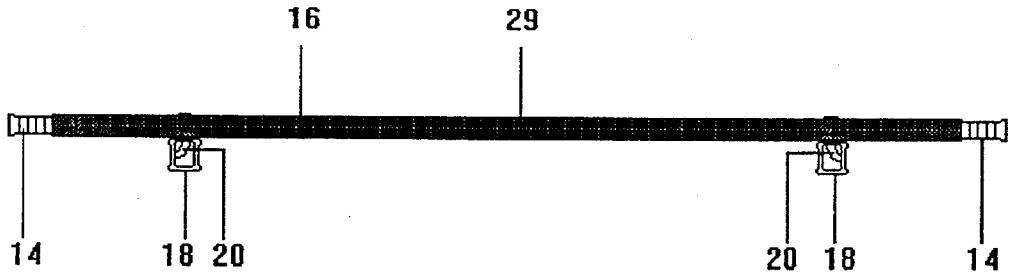
FIG. 1 is a plan view of the first embodiment stretcher in the unfolded configuration.

FIG. 1 is a side view of the first embodiment folding stretcher 10 in the unfolded configuration. FIG. 1 shows the tubular pole 12, hand grips 14, stretcher bed 16, sleeve 29 which receives the tubular pole 12, stretcher bar assemblies 20, and stirrups 18, attached to each tubular pole between the middle of the tubular pole and the hand grip. Stirrups act as feet and support the stretcher above the ground when the stretcher is placed on the ground.

Figure 2:
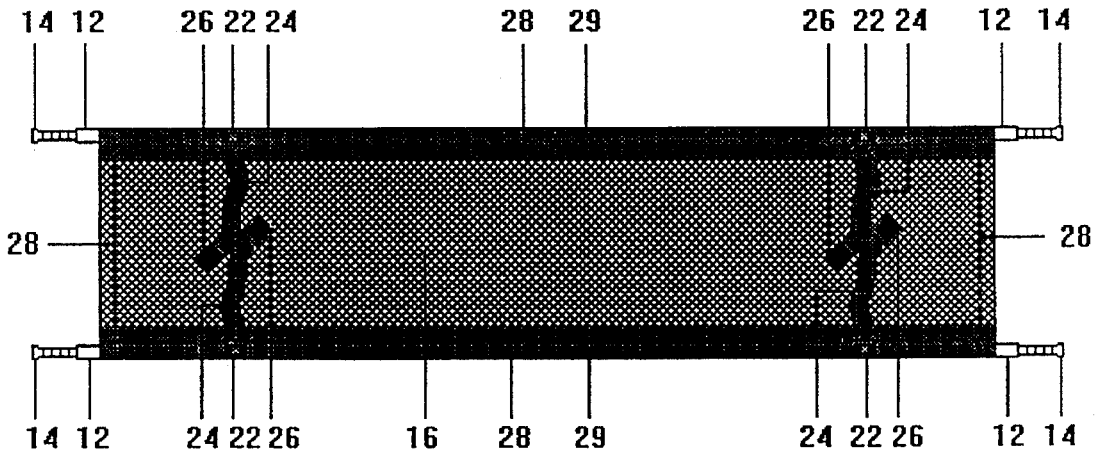
FIG. 2 is a top view of the first embodiment stretcher in the unfolded configuration.

FIG. 2 is a top view of the first embodiment folding stretcher 10 in the unfolded configuration. This figure shows the tubular poles 12 which extend along each side of the stretcher. Hand grips 14 are attached to each end of each pole to enable the stretcher to be lifted. The stretcher bed 16 is constructed of fabric woven in the form of large honeycomb net preferably with 40% of the surface area open to allow liquid to pass through. Materials with from 10% to 90% of the surface area open to allow liquid to pass through are suitable for use. Loops 29 are formed along the length of the stretcher bed 16 on each side and are used to receive the tubular poles 12. Each loop 29 is form by a hem 28 running along the length of each side of the stretcher bed 16. Two strap assemblies for retaining the patient on the stretcher are shown on FIG. 2. Each strap assembly consists of a first strap 24 attached to a tubular pole 12 by a fastener 22, and a second strap 25 fastened to the other tubular pole by a fastener 22. When a patient is on the stretcher, the first strap 24 is connected to the second strap 25 by buckles 26, thereby securing the patient to the stretcher. The buckles 26 are side release buckles, which allow easy use with heavy gloves.

Figure 3:
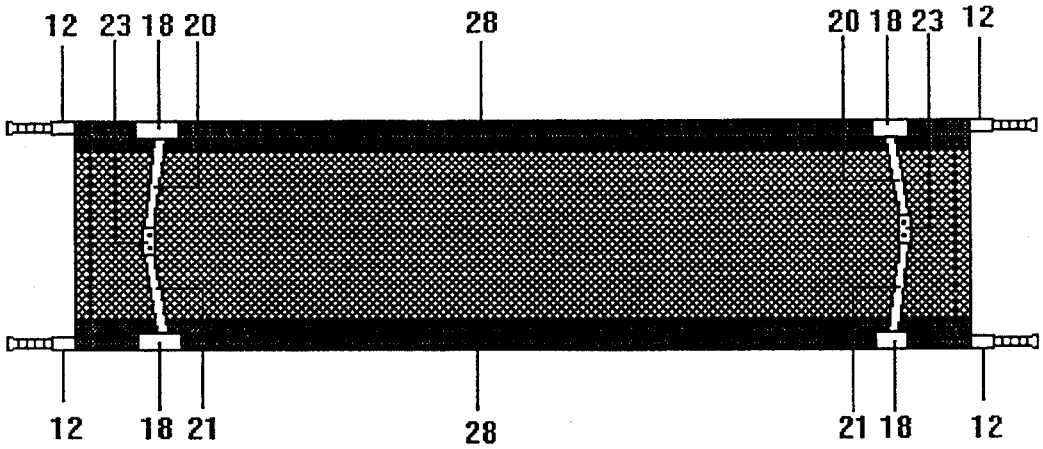
FIG. 3 is a bottom view of the first embodiment stretcher in the unfolded configuration.

FIG. 3 is the bottom view of the first embodiment stretcher 10 in the unfolded configuration. Two stirrups 18 are attached to each tubular pole 12. A spreader assembly 17 is attached to each tubular pole at each stirrup. Each spreader assembly 17 consists of a left spreader bar 20 pivotally attached by a first end to a tubular pole 12, and a coupler 23 pivotally attached to the second end of the left spreader bar. A right spreader bar 21 is pivotally attached to the other tubular pole 12 at a first end and pivotally attached at the second end to the coupler 23. The spreader assembly is in the extended position in FIG. 3. The spreader assemblies hold the stretcher in the open unfolded configuration shown in FIGS. 2 and 3.

Figure 4:
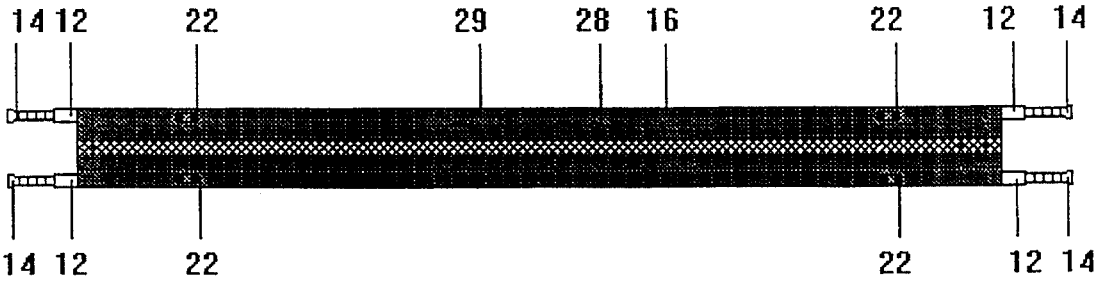
FIG. 4 is a top view of the first embodiment stretcher in the folded configuration.

FIG. 4 shows a top view the first embodiment stretcher in the folded configuration. The width of the stretcher is reduced by approximately 85% by folding the spreader assemblies.

Figure 5:
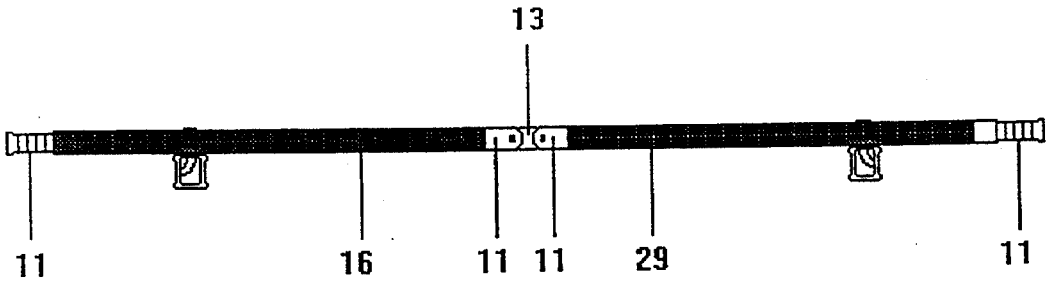
FIG. 5 is a plan view of the second embodiment stretcher in the unfolded configuration.

FIG. 5 is a side view of the second embodiment stretcher 30 in the unfolded and uncollapsed configurations. The features are as in the first embodiment stretcher 20 with the exception of a collapsing assembly 19 at the middle of each tubular pole 11 and a modification 27 of the stretcher bed 16. The collapsing assembly 19 consists of a hinge plate 13 pivotally attached to the ends of tubular poles 11. The collapsing assembly 19 acts as an one way hinge which allows the collapsing of the folded stretcher, thereby reducing the length by approximately one half to facilitate storage and transportation of the folded stretcher. The collapsing assembly folds in one direction only; it retains the strength and rigidity of the tubular pole when the stretcher is used to support or carry a person.

Figure 6:
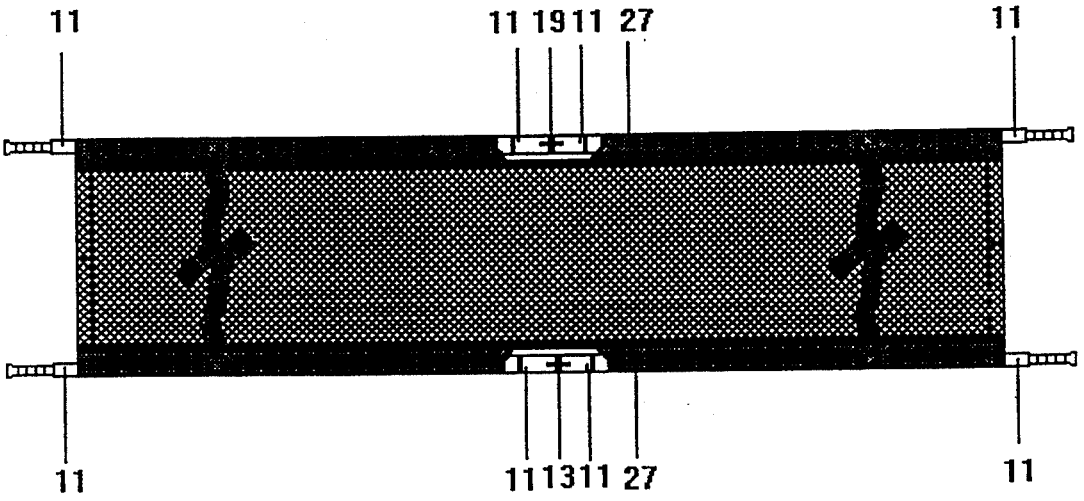
FIG. 6 is a top view of the second embodiment stretcher in the unfolded configuration.

FIG. 6 is a top view of the second embodiment stretcher 30 in the unfolded and uncollapsed configurations. The collapsing assemblies 19 are visible. The stretcher bed 16 is modified by a hemispheric cut 27 surrounding each collapsing assembly.

Figure 7:
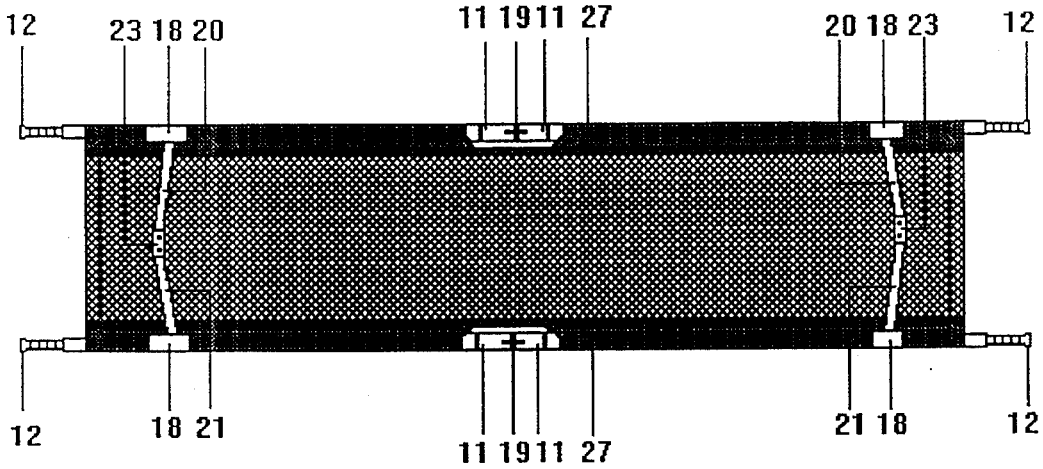
FIG. 7 is a bottom view of the second embodiment stretcher.

FIG. 7 is a bottom view of the second embodiment stretcher 30 in the unfolded an uncollapsed configurations. Visible are the collapsing assemblies 19 and the hemispheric cuts 27 in the blanket bed 16.

Figure 8:
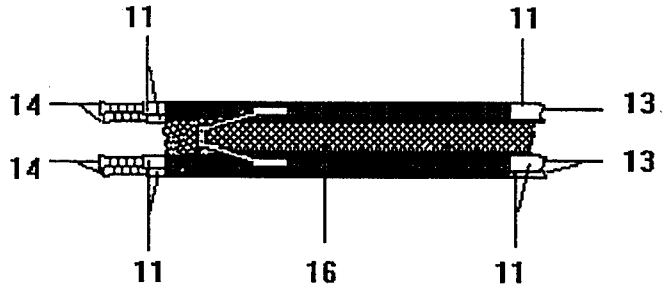
FIG. 8 is a top view of the second embodiment stretcher in the folded and collapsed configuration.

FIG. 8 is a top view of the second embodiment stretcher 30 in the folded and collapsed configurations. The width of the stretcher in the folded configuration is reduced as in the first embodiment stretcher shown in FIG. 4. The length of the folded stretcher is reduced to approximately half by the collapsing assembly 19. Visible are the tubular poles 11 and the hinge plate 13.

Figure 9:
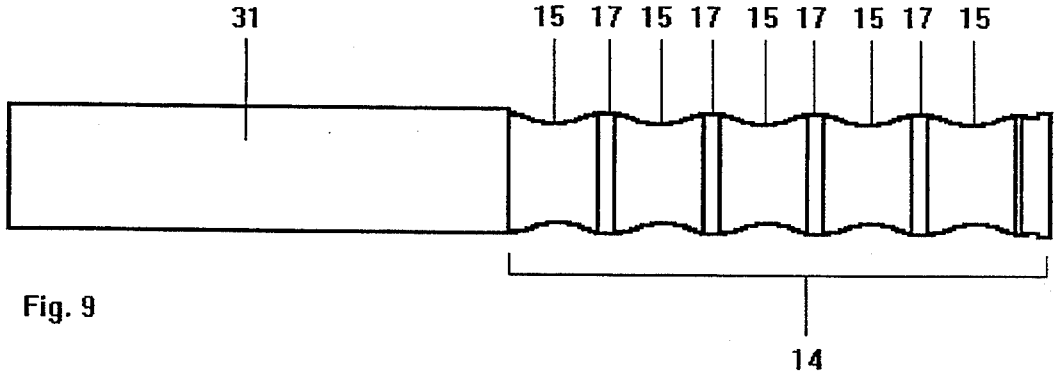
FIG. 9 is a plan view of the stretcher handle.

FIG. 9 shows the hand grip 14. Five grooves 15 are interspersed with ridges 17. The grooves and ridges afford a secure grip to a person who lifts the stretcher while wearing heavy rubber gloves. A grip extension 31 is forms the second end of the hand grip. The grip extension is inserted into the tubular pole and attaches the hand grip to the tubular pole. The hand grip is secured to the tubular pole by fastening means such as a screw, rivet, or stud.

Figure 10:
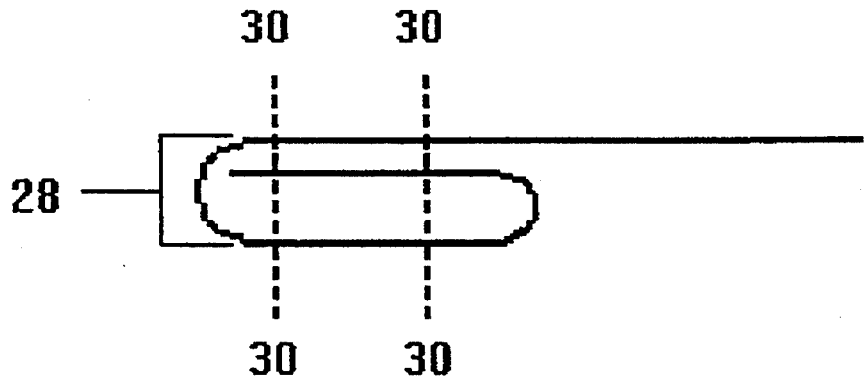
FIG. 10 is an end view of the first embodiment hem.

FIG. 10 shows details of the first embodiment hem 28. Hemming is by cuffing or rolling the sides of the 3/3 broken twill through out the length of the monofilament bed. The stitching 30 preferably is double needle locking with polyester thread. Other threads may be used, such as polyamides, or blends of polyester and polyamides.

Figure 11:
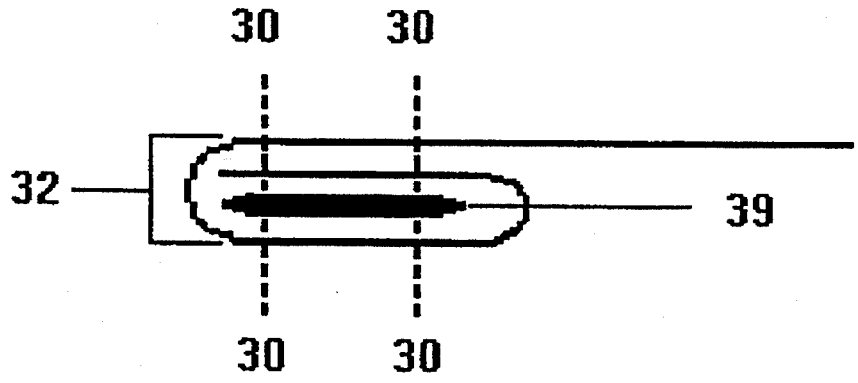
FIG. 11 is an end view of the second embodiment hem.

FIG. 11 shown a second embodiment hem in which the hem 32 is reinforced by a reinforcing ribbon 34 which is sewn into the hem using stitching 30 as in the first embodiment. Hemming with the use of the reinforcing ribbon makes it possible to use the honeycomb new or mesh throughout the width of the stretcher bed. Hemming in the absence of a reinforcing ribbon produces hems without adequate strength to support patients. By using a hem with a reinforcing ribbon the resultant stretcher net is more open, which aids the decontamination process.

The materials of construction are important to this invention.

The tubular poles and other elements of the frame are constructed of strong, light metals or of strong, light wood. The preferred metal is aluminum or aluminum alloys. Other materials may be used, such as titanium, steel, copper, and alloys of these metals. Wood also may be used.

The frame is coated with a chemical resistant paint to protect the frame with hazardous materials and weathering. The preferred chemical resistant paint is polyurethane. Other chemical agent resistant paints may be used, such as epoxy, hybrid, or polyester paints.

The hand grips are constructed of rigid strong flame-retardant and UV protected hazardous material resistant plastic to protect the grips from hazardous materials, fire, and sunlight. A preferred material of construction is polyhexamethylene polyamide (nylon 6/6) made flame retardant by inclusion of 13% PC Conc.33 from Mammoth Plastics and UV light protected by inclusion of carbon black. Other suitable materials which may be included or used include high density polyethylene, polyester, fiberglass, or other polyamide.

The bed material is made of strong flexible flame retardant and UV protected monofilament polypropylene fibers which are resistant to hazardous materials, fire, and UV light. Flame retardant properties result from inclusion in the monofilament polypropylene fibers 13% PT Conc.33, from Mammoth Plastics. UV light protection results from inclusion of carbon black in the monofilament polypropylene. The bed fiber preferably is continuous monofilament polypropylene which is woven into a honeycomb and 3/3 broken twill. Polypropylene monofilament has been shown to be suitable for use in stretcher beds in that it is resistant to hazardous materials, fire, and UV light. (R. L. Joiner, F. G. Burton, and P. E. Bailey, Neat Agent Testing On Field Litter Cover Materials, Report No. AD-B117 108, Battelle Columbus Division, Sep. 30, 1987). Other bed fibers suitable to a greater or lesser degree which may be woven into a honeycomb net or mesh design include polyester, polyamides, and a blend of polyester and polyamide.

The alternative reinforcing ribbon and the straps are made of the same materials as the fibers of the bed material. The reinforcing ribbon may differ from the bed material in that it is closely woven as opposed to being woven in a honeycomb net or mesh. A preferable material for a reinforcing ribbon is monofilament polypropylene in a 3/3 broken twill weave or a trampoline style weave. Alternatively, the reinforcing ribbon may be a non-woven solid webbing of monofilament polypropylene or other materials suitable for the bed. Use of the reinforcing ribbon when desired provides additional strength to the hemming of the honeycomb net or mesh stretcher bed.

The straps may be made of suitable strong, hazardous material, fire and UV light resistant materials, such as 3/3 broken twill monofilament polypropylene and materials suitable for the bed.

The buckle is made of polypropylene which is resistant to hazardous materials. The buckle is a side release buckle, which allows easy operation by a person wearing heavy gloves. Other materials may be used, such a metals coated with chemical resistant paint, chemical resistant metals, polyamide, polyester, high density polyethylene, and acrylic.

The decontaminatable stretchers of this invention may be used as any conventional folding or folding and collapsible stretcher, additionally, the present stretcher my be used to transport a contaminated patient from a contaminated environment, the patient may be decontaminated while on the stretcher, and the stretcher my be used to transport the patient from the contaminated environment to a medical facility. The decontamination process used to decontaminate the patient is spraying, washing, or blotting the patient with water, detergent solution in water, or other required chemical decontaminate solutions, also serves to decontaminate the stretcher.

The honeycomb net and mesh design of the stretcher bed serves three important functions in this invention. The large mesh of the bed allows portions of the patient's flesh to protrude into and partially through the stretcher bed, thereby securing the patient and minimizing slippage from the stretcher while the decontamination process occurs. In addition, the large mesh insures that only a small portion of the patient's body is in actual contact with the stretcher bed material. This facilitates the decontamination process by eliminating areas of the patient's body which are inaccessible to decontamination. In particular, a patient supported on the stretcher may be decontaminated by spraying of decontaminating solution on the patient from below the stretcher bed as well as from above. Finally, the use of the honeycomb bed and mesh allows easy drainage of hazardous material away from the patient and reduces the splatter and spreading of hazardous material runoff.

These considerations are particularly important because the decontaminated hazardous materials are often converted into materials which, while less hazardous than the original contaminating chemicals, are nevertheless still regarded as hazardous. In addition, decontaminating solvents or solutions may be as simple and innocuous as water, but also may include caustic solutions, such as water solutions of weak acids, which may be used to decontaminate chemical bases. These "neutralizing" decontamination solutions are in themselves hazardous materials which must be treated as such. This stretcher therefore also minimized the exposure of the patient to hazardous decontaminating solutions.

Use of this stretcher has the advantage of eliminating the current need to transfer the patient from the first contaminated stretcher to a second stretcher type device or backboard at the decontamination site. This reduces the chance of additional injury or aggravation of previous injuries to the patient while also reduces the time required for the decontamination process. In addition, the present stretcher avoids the pooling of hazardous materials at the sites where contact is made between the patient's body and the support, as occurs when the patient is decontaminated on a backboard. Finally, use of the present stretcher avoids the second transfer of patient from the decontaminating support to a second, uncontaminated, stretcher for transfer to a medical facility.

Use of the present stretcher therefore avoids the delay and potential injury associated the decontamination process and transferring a patient from one support to another, and avoids the cost of additional stretchers or backboards.

It will be apparent to those skilled in the art that the examples and embodiments described herein are by way of illustration and not of limitation, and the other examples may be used without departing from the spirit and scope of the present invention, as set forth in the appended claims.

I claim:

1. A folding stretcher for transporting injured or contaminated persons who have been exposed to hazardous materials comprising:

a frame constructed of light strong metal comprising tubular poles, spreader bar assemblies attached to said poles for securing the stretcher in a folded or unfolded configuration, the folded configuration having reduced width, and stirrups attached to said poles, said frame coated with chemical resistant paint to protect said frame from hazardous materials and weathering, each said tubular pole having at the middle of its length a collapsing assembly whereby the length of said folding stretcher while in the folded configuration may be reduced by half, a hand grip constructed of fiberglass and polyhexamethylene polyamide to resist hazardous materials and UV light, said grip having alternate grooves and ridges to provide a firm grip and reduce hand and arm fatigue for a user wearing heavy rubber gloves, and a grip extension, said grip attached to said tubular pole by insertion of said grip extension into said tubular pole and securing said grip to said pole by fastening means, a fabric bed woven of flame retardant and UV protected monofilament polypropylene to resist hazardous materials, fire and UV light, said bed woven in a blend of mesh and honeycomb weave having 10%–90% of the surface area open to allow liquid to pass through the bed, secure the patient to the bed, and minimize contact of the patient with the bed, said bed attached to said tubular poles by a sleeve at each side of said bed, and said sleeve comprised of a fold of bed fabric secured to said bed by a hem.

2. The folding stretcher of claim 1 wherein said spreader bar assembly consists of a left spreader bar, a right spreader bar, and a coupler, said left spreader bar pivotally attached to a first pole at a first end and attached to said coupler at a second end by a rivet, and said right spreader bar pivotally attached to a second pole at a first end and attached to said coupler at a second end by a rivet.

3. The folding stretcher of claim 1 wherein at least two stirrups are attached to each tubular pole between the middle of the pole and the hand grip, each stirrup serving to support the bed of the stretcher above the ground when the stretcher is placed on the ground.

4. The folding stretcher of claim 1 wherein said tubular pole is manufactured of aluminum or aluminum alloy.

5. The folding stretcher of claim 1 wherein said hand grip has five grooves.

6. The folding stretcher of claim 1 wherein said fastening means for securing said hand grip to said pole is a screw.

7. The folding stretcher of claim 1 wherein said hem includes a reinforcing ribbon.

8. The folding stretcher of claim 1 wherein said collapsing assembly comprises a hinge joint whereby the handle ends of a pole approach each other when the stretcher is collapsed, while said hinge joint retains the rigidity of tubular poles without a hinge joint while the stretcher is in use.

9. The folding stretcher of claim 1 wherein the hinge joint comprises a hinge plate attached by rivets to the tubular pole.

10. The process of decontaminating a injured person contaminated by exposure to a hazardous material at a contaminated site comprising the steps:

A. placing the contaminated person on the stretcher of claim 1,

B. transporting the contaminated person to an area away from the contaminated site and free of hazardous material, and C. decontaminating the contaminated person by spraying the contaminated person from below the stretcher with water or other decontaminating solvents appropriate to the specific hazardous material while the contaminated person is on the stretcher.

11. The process of claim 10 further comprising the step after step C:

D. transporting the decontaminated person on the stretcher to a medical treatment facility.

* * * * *